US007448736B2

(12) United States Patent
Hong et al.

(10) Patent No.: US 7,448,736 B2
(45) Date of Patent: Nov. 11, 2008

(54) INKJET PRINTHEAD ASSEMBLY AND INK SUPPLY APPARATUS FOR THE SAME

(75) Inventors: Young-ki Hong, Anyang-si (KR); Jae-woo Chung, Suwon-si (KR); You-seop Lee, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 382 days.

(21) Appl. No.: 11/345,376

(22) Filed: Feb. 2, 2006

(65) Prior Publication Data

US 2006/0176347 A1 Aug. 10, 2006

(30) Foreign Application Priority Data

Feb. 5, 2005 (KR) ..... 10-2005-0010991

(51) Int. Cl.
*B41J 2/175* (2006.01)

(52) U.S. Cl. ..... 347/85; 347/88

(58) Field of Classification Search ..... 347/85, 347/88, 92, 99

See application file for complete search history.

(56) References Cited

U.S. PATENT DOCUMENTS

| | | | | |
|---|---|---|---|---|
| 4,593,292 | A * | 6/1986 | Lewis | 347/88 |
| 4,814,786 | A * | 3/1989 | Hoisington et al. | 347/88 |
| 4,940,995 | A * | 7/1990 | Hine et al. | 347/89 |
| 5,105,209 | A * | 4/1992 | Koto et al. | 347/70 |
| 5,605,659 | A * | 2/1997 | Moynihan et al. | 264/430 |
| 5,621,444 | A * | 4/1997 | Beeson | 347/88 |
| 6,007,193 | A * | 12/1999 | Kashimura et al. | 347/92 |
| 7,322,668 | B2 * | 1/2008 | Kim | 347/21 |

FOREIGN PATENT DOCUMENTS

EP 1 238 809 9/2002

* cited by examiner

*Primary Examiner*—Anh T. N. Vo
(74) *Attorney, Agent, or Firm*—Lee & Morse, P.C.

(57) ABSTRACT

An inkjet printhead assembly including an inkjet printhead chip having an ink inflow hole, a frame having an ink supply hole, and an ink supply apparatus having a preheater and an ink supply outlet, wherein the frame is disposed between the inkjet printhead chip and the ink supply apparatus, the inkjet printhead chip is attached to the frame, and the ink supply hole is disposed between the ink supply outlet and the ink inflow hole, so as to channel ink between the ink supply apparatus and the inkjet printhead chip.

19 Claims, 10 Drawing Sheets

INKJET PRINTHEAD ASSEMBLY AND INK SUPPLY APPARATUS FOR THE SAME

BACKGROUND OF THE INVENTION

1. Field of the Invention

The present invention relates to an inkjet printhead assembly. More particularly, the present invention relates to an inkjet printhead assembly that can control ink viscosity and maintain a uniform ink supply pressure, the assembly including an inkjet printhead and an ink supply apparatus.

2. Description of the Related Art

Generally, an inkjet printhead forms an image having a predetermined color on a printing medium, e.g., a sheet of paper, a fabric, a substrate, etc., by ejecting ink droplets onto a desired region of the printing medium. An inkjet printhead may be fabricated in the form of a chip using various methods, e.g., methods commonly used in semiconductor manufacturing. The fabricated inkjet printhead chip may be assembled with other components and packaged as a unit.

The viscosity of the ink used in the inkjet printhead may affect the printing performance of the inkjet printhead. For example, if ink having a high viscosity is ejected through the inkjet printhead, the volume and speed of ejected ink droplets may be lowered in proportion to the ink viscosity. Therefore, the inkjet printhead may have a low ink ejecting performance when ejecting viscous ink.

Further, since the inkjet printhead may undergo acceleration and deceleration while moving in a printing device at high speed, it may be difficult to stably supply ink to the inkjet printhead at a uniform ink supply pressure. Therefore, the ink ejecting performance of the inkjet printhead may vary. Thus, since the ink ejecting performance may decrease or vary unreliably when the viscosity of the ink is too high, when the viscosity varies, or when the inkjet printhead is subjected to rapid movement, it may be difficult to obtain the desired printing quality.

SUMMARY OF THE INVENTION

The present invention is therefore directed to an inkjet printhead assembly, including an inkjet printhead and an ink supply apparatus, which substantially overcomes one or more of the problems due to the limitations and disadvantages of the related art.

It is therefore a feature of an embodiment of the present invention to provide an inkjet printhead assembly including one or more heaters for heating ink.

It is therefore another feature of an embodiment of the present invention to provide an inkjet printhead assembly including pressure compensating features for maintaining a stable ink pressure.

At least one of the above and other features and advantages of the present invention may be realized by providing an inkjet printhead assembly including an inkjet printhead chip having an ink inflow hole, a frame having an ink supply hole, and an ink supply apparatus having a preheater and an ink supply outlet, wherein the frame is disposed between the inkjet printhead chip and the ink supply apparatus, the inkjet printhead chip is attached to the frame, and the ink supply hole is disposed between the ink supply outlet and the ink inflow hole, so as to channel ink between the ink supply apparatus and the inkjet printhead chip.

The inkjet printhead chip may include a plurality of ink chambers communicating with the ink inflow hole, a plurality of actuators corresponding to the plurality of ink chambers, and a plurality of nozzles corresponding to the plurality of ink chambers. The inkjet printhead assembly may further include a heater disposed on a surface of the frame opposite the inkjet printhead chip. The inkjet printhead assembly may further include a heater cover disposed on the heater and pressing the heater against the frame.

The frame may include a mounting groove in a bottom surface thereof, and the inkjet printhead chip may be disposed in the mounting groove. The ink supply apparatus may further include a preheating plate, an ink reservoir and a pressure adjusting film. The preheating plate may include an ink path having a first ink inlet and a first ink outlet, the ink reservoir may include an ink-containing space and a second ink inlet communicating with the first ink outlet, the pressure adjusting film may be attached to the ink reservoir and cover the ink-containing space, and the preheater may be disposed between, and in thermal contact with, the preheating plate and the ink reservoir. The ink reservoir may include a spring and a pressure adjusting film that are configured to maintain an ink pressure below a predetermined pressure.

At least one of the above and other features and advantages of the present invention may also be realized by providing an ink supply apparatus for an inkjet printhead chip including a preheating plate including an ink path having a first ink inlet and a first ink outlet, an ink reservoir including an ink-containing space, a second ink inlet communicating with the first ink outlet, and a second ink outlet communicating with the inkjet printhead chip, a pressure adjusting film attached to the ink reservoir and covering the ink-containing space, and a preheater disposed between, and in thermal contact with, the preheating plate and the ink reservoir.

The ink path may further include a groove defined in a surface of the preheating plate, and a heat-exchanging tube installed in the groove, wherein the first ink inlet is one end of the heat-exchanging tube and the first ink outlet is another end of the heat-exchanging tube. The ink supply apparatus may further include a temperature sensor disposed on the preheating plate. The ink reservoir and the pressure adjusting film may be formed of a same material and are fused together.

The second ink inlet may extend from a top outer surface of the ink reservoir to a bottom of the ink-containing space, such that ink enters the ink-containing space at the bottom. The second ink outlet may extend from a bottom of the ink-containing space to a bottom outer surface of the ink reservoir. The ink supply apparatus may further include an air vent in the ink reservoir, the air vent communicating with the ink-containing space. The air vent may extend from a top outer surface of the ink reservoir to a top of the ink-containing space.

The ink supply apparatus may further include a filter disposed in the ink-containing space near the second ink outlet and configured to filter ink passing through the second ink outlet. The ink-containing space may have a concave recess in a wall thereof, the concave recess communicating with the second ink outlet, and the filter may span the concave recess. A spring may be installed in the ink-containing space, and the spring and the pressure adjusting film may be configured to maintain an ink pressure below a predetermined pressure.

The preheater may include two insulating plates arranged in parallel with each other, a heating coil disposed between the two insulating plates, and a power supply line connected to the heating coil.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
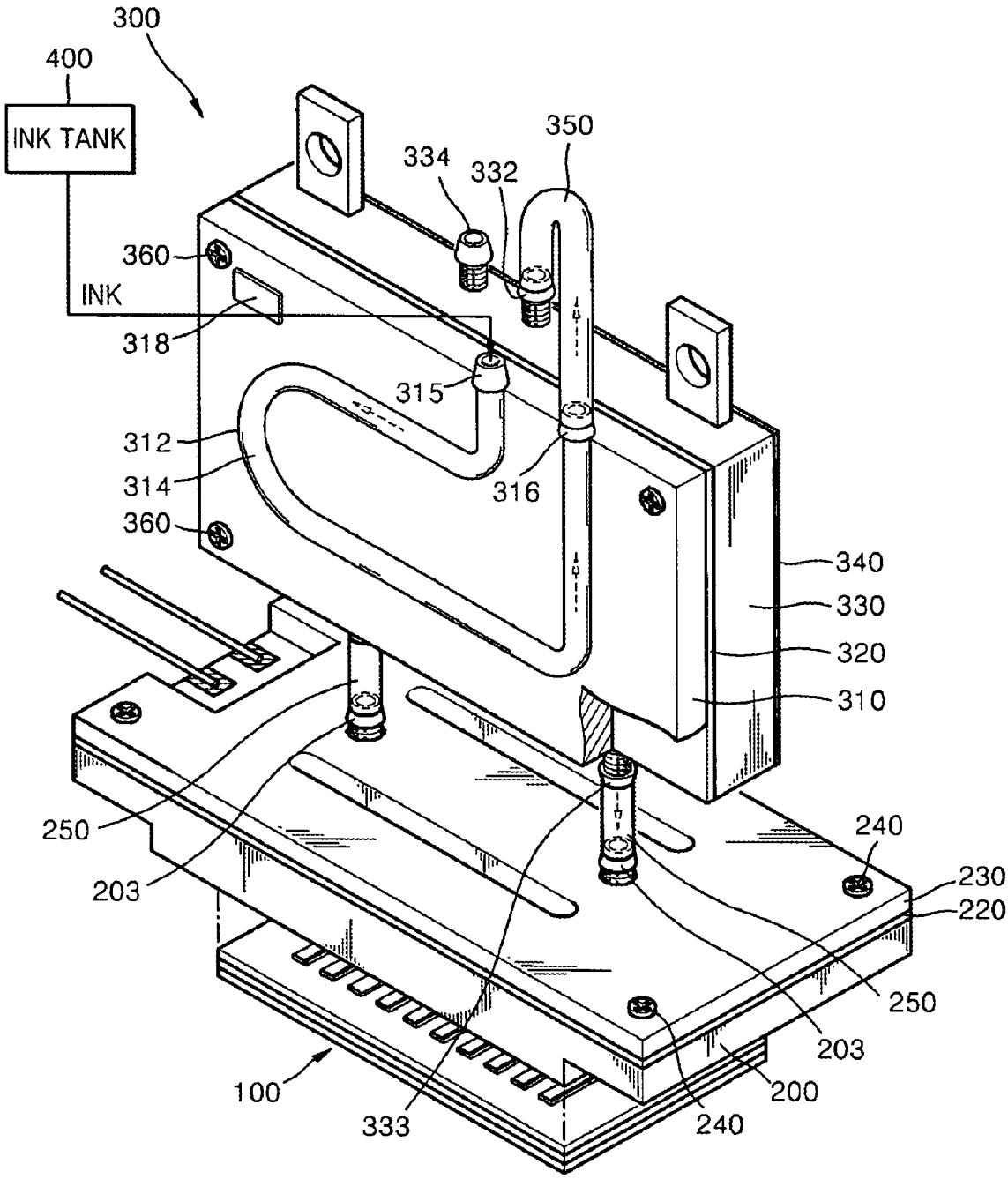
FIG. 1 illustrates a perspective view of an inkjet printhead assembly according to an embodiment of the present invention.

Korean Patent Application No. 10-2005-0010991, filed on Feb. 5, 2005, in the Korean Intellectual Property Office, and entitled: "Ink Supply Apparatus and Inkjet Printhead Assembly Having the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

An inkjet printhead assembly according to the present invention may provide a number of advantages. In particular, ink may be efficiently heated to the required temperature by a preheater interposed between a preheating plate and an ink reservoir. Thus, the inkjet printhead chip may eject viscous ink at a high level of performance. An auxiliary heater may be installed adjacent to the inkjet printhead chip, such that ink in the inkjet printhead chip may be heated more uniformly. The temperature of the heated ink may be maintained at a desired temperature by attaching a temperature sensor to the preheating plate.

In addition, ink may be supplied to the inkjet printhead chip from the ink reservoir at a uniform pressure by using a pressure adjusting film attached to the ink reservoir. Thus, the inkjet printhead chip may eject ink droplets through a plurality of nozzles with a uniform speed and ink-droplet volume, so that stable ink ejection may be obtained. Also, since the ink reservoir and the pressure adjusting film may be formed of a same material, and thus may be easily and firmly attached to each other.

Further, foreign substances may be effectively removed from the ink using filters installed in the ink reservoir, and air may be effectively removed from the ink via an air vent in the ink reservoir.

Figure 2:
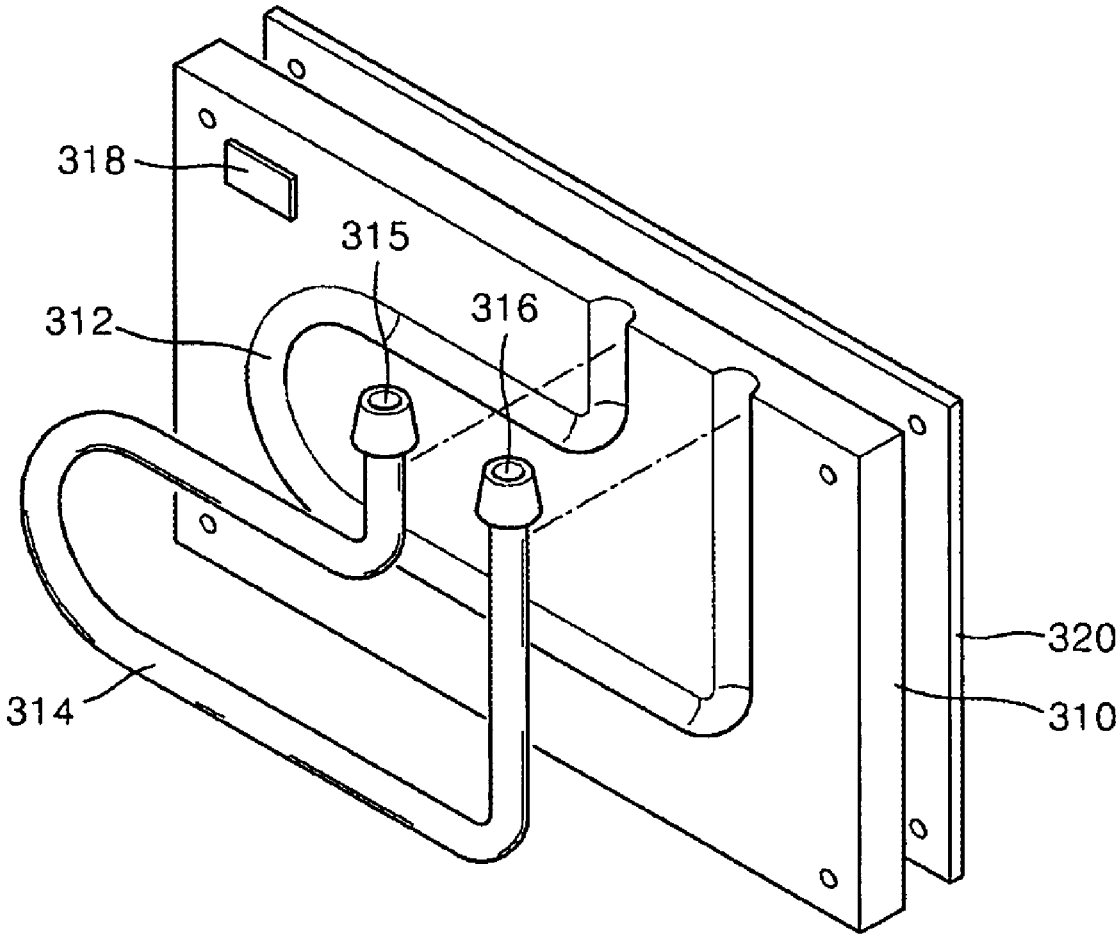
FIG. 2 illustrates an exploded perspective view of a preheating plate depicted in FIG. 1.
Figure 3:
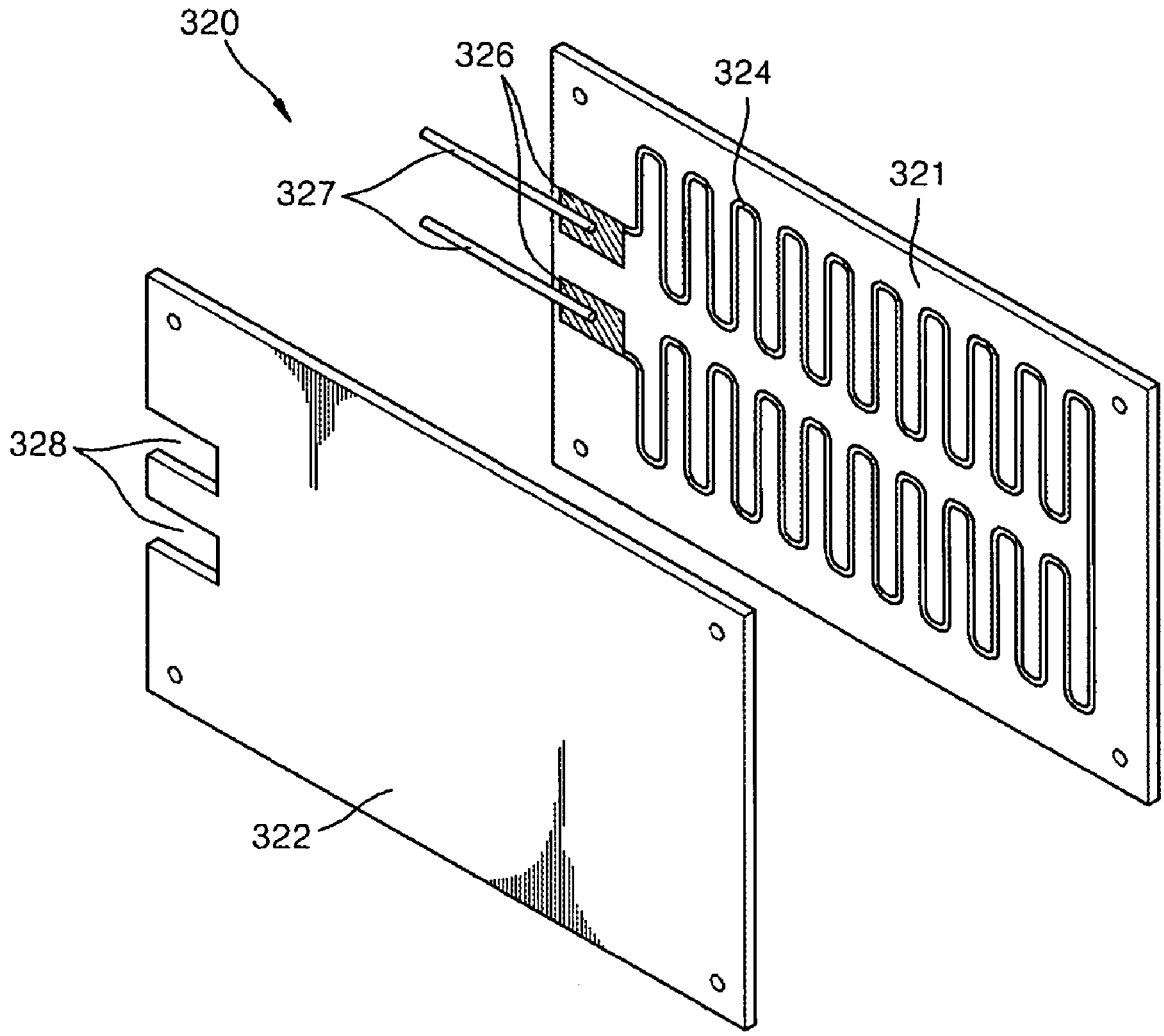
FIG. 3 illustrates an exploded perspective view of a preheater depicted in FIG. 1.
Figure 4:
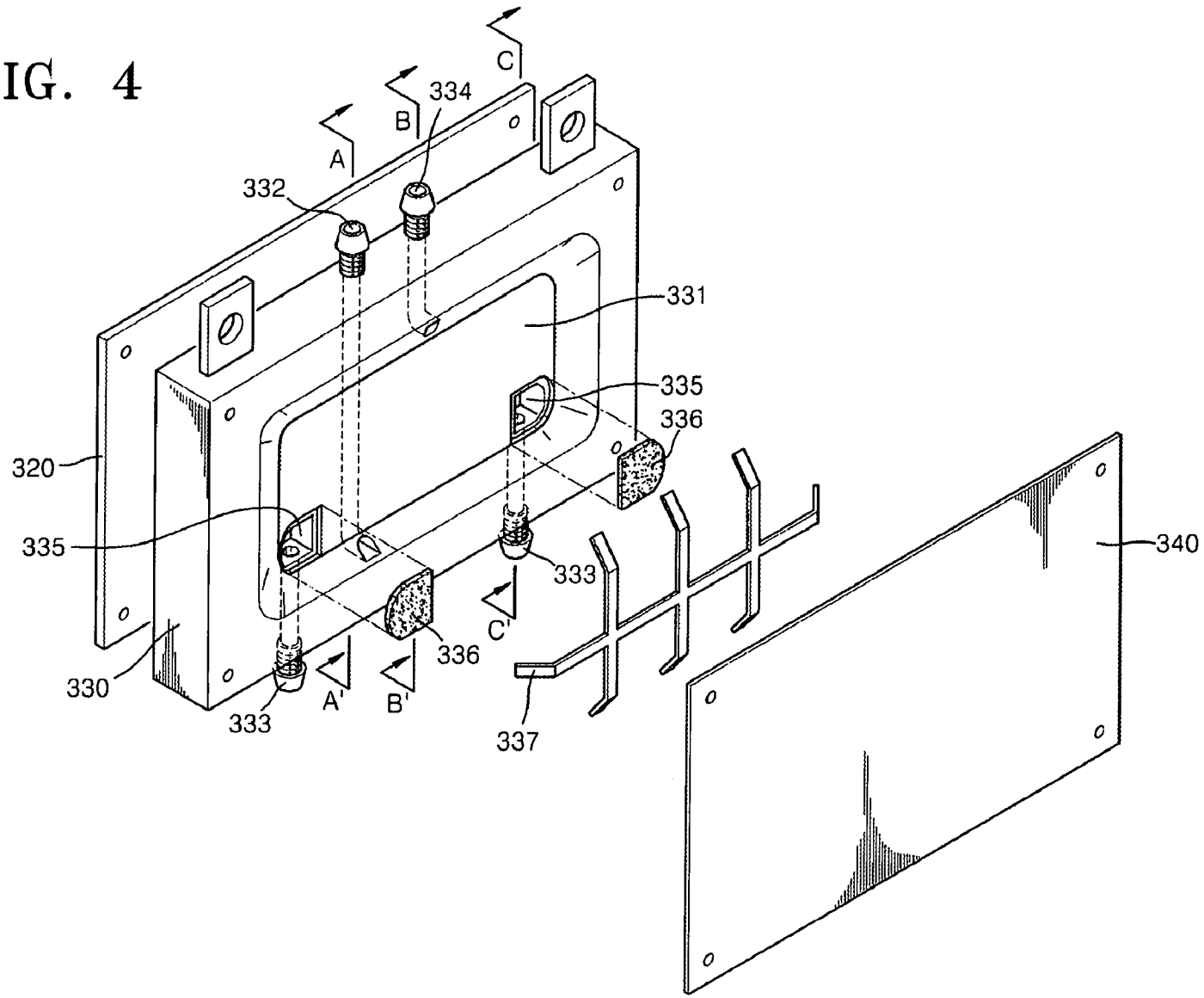
FIG. 4 illustrates an exploded perspective view of an ink reservoir depicted in FIG. 1.

FIG. 1 illustrates a perspective view of an inkjet printhead assembly according to an embodiment of the present invention, and FIGS. 2-4 illustrate, respectively, exploded perspective views of a preheating plate, a preheater and an ink reservoir of FIG. 1.

Referring to FIG. 1, the inkjet printhead assembly may include an inkjet printhead chip 100, a frame 200, having the inkjet printhead chip 100 installed thereon, and an ink supply apparatus 300. The inkjet printhead chip 100 ejects ink droplets onto a predetermined region of a printing medium to form a desired image having a predetermined color on a surface of the printing medium. The inkjet printhead chip 100 may be mounted on the bottom of the frame 200, as will be further described below. The inkjet printhead chip 100 may receive ink from the ink supply apparatus 300. The ink supply apparatus 300 may supply ink to the inkjet printhead chip 100 and may include a preheating plate 310, a preheater 320, an ink reservoir 330 and a pressure adjusting film 340.

The preheating plate 310 may preheat ink supplied to the inkjet printhead chip 100 from an ink tank 400, i.e., the preheating plate 310 may subject the ink to an initial heating. The preheating plate 310 may be formed of a metal having a high thermal conductivity, e.g., aluminum, aluminum alloy, etc.

The ink reservoir 330 may receive the ink from the preheating plate 310 and heat the ink again, i.e., it may subject the ink to a second heating. A pressure adjusting film 340 may be attached to the ink reservoir 330 to help regulate the pressure of the ink stored in the ink reservoir 330. The ink reservoir 330 may be formed of plastic, e.g., polypropylene (PP), polyethylene (PE), polytetrafluoroethylene (PTFE), etc., for easy attachment of the pressure adjusting film 340.

The preheater 320 may have a flat plate shape and may be disposed between the preheating plate 310 and the ink reservoir 330. The preheating plate 310, the preheater 320 and the ink reservoir 330 may be securely coupled together using, e.g., a plurality of screws. The preheater 320 may be in thermal contact with the preheating plate 310 and the ink reservoir 330, in order to efficiently heat ink passing through the preheating plate 310, and ink stored in the ink reservoir 330.

As mentioned above, since the flat preheater 320 may be disposed between the preheating plate 310 formed of, e.g., aluminum or aluminum alloy, and the ink reservoir 330 formed of, e.g., plastic, the ink can be initially heated at the preheating plate 310 and secondarily heated in the ink reservoir 330. Therefore, according to the present invention, ink exhibiting a high viscosity may be more efficiently heated to a sufficient temperature, and thus may be efficiently ejected.

The structure of the ink supply apparatus 300 will now be described in detail. First, the structure of the preheating plate 310 will now be more specifically described with reference to FIGS. 1 and 2. The preheating plate 310 may include an ink path having a first ink inlet 315 and a first ink outlet 316. The first ink inlet 315 may provide for inflow of ink from the ink tank 400, and the first ink outlet 316 may provide for outflow of the ink. The preheating plate 310 may be in contact with one side of the preheater 320 for receiving heat from the preheater 320, such that the ink passing through the ink path may be heated to a predetermined temperature.

Various kinds of ink may be supplied using the ink supply apparatus 300, as may be required by the particular application. Since water-soluble ink may react with aluminum, such water-soluble ink passing through the ink path should be prevented from making direct contact with the preheating plate 310 if it is formed of aluminum or aluminum alloy. In such a case, as shown in FIGS. 1 and 2, the ink path may include a groove 312 formed in a surface of the preheating plate 310 opposite to the preheater 320, and a heat-exchanging tube 314 installed in the groove 312. The first ink inlet 315 may be formed on one end of the heat-exchanging tube 314, and the first ink outlet 316 may be formed on the other end of the heat-exchanging tube 314. The heat-exchanging tube 314 may be formed of a relatively non-reactive material such as, e.g., stainless steel, which is generally non-reactive towards water-soluble ink as well as many others, such that a wide variety of ink may be used with the heat-exchanging tube 314. Using the illustrated arrangement, heat may be transferred from the preheater 320 to the preheating plate 310, and then to the heat-exchanging tube 314, such that ink inside the heat-exchanging tube 314 may be heated.

The preheating plate 310 may include a temperature sensor 318, e.g., a thermistor, which is a widely used semiconductor-based temperature sensor formed by mixing and sintering various metallic oxides whose electrical resistance sensitively varies as a function of temperature. However, the temperature sensor 318 of the present invention is not limited to a thermistor, and other suitable temperature sensors may be used.

The temperature sensor 318 may be attached to a surface of the preheating plate 310 to directly sense the temperature of the preheating plate 310, such that the temperature of ink inside the heat-exchanging tube 314 can be indirectly determined. The temperature of the ink may be properly maintained by controlling power to the preheater 320 based on the temperature sensed using the temperature sensor 318. For example, the temperature sensed using the temperature sensor 318 may be compared with a reference temperature that is preset according to the desired viscosity of the ink to be ejected. When the sensed temperature is lower than the reference temperature, power may be supplied to the preheater 320 to generate heat, and when the sensed temperature is higher than the reference temperature, power may be cut off to the preheater 320.

The structure of the preheater 320 will now be described with reference to FIGS. 1 and 3. The preheater 320 may include first and second insulating plates 321 and 322 arranged in parallel with each other, a heating coil 324 disposed between the first and second insulating plates 321 and 322, and power supply lines 327 connected to the heating coil 324. The first and second insulating plates 321 and 322 may be formed of, e.g., plastic having electrical and thermal insulating properties.

The heating coil 324 may be configured to cover a substantial surface of the first insulating plate 321. The first insulating plate 321 may include two contact pads 326 attached to one side of a surface thereof, which may be connected with two ends of the heating coil 324, respectively. The heating coil 324 may be formed of, e.g., a nichrome or stainless steel wire. The heating coil 324 may receive power from the power supply lines 327 connected to the contact pads 326. The second insulting plate 322 may define openings 328 to expose the contact pads 326 attached to the surface of the first insulating plate 321.

The structures of the ink reservoir 330 and the pressure adjusting film 340 will now be described with reference to FIGS. 1 and 4. The ink reservoir 330 may include an ink-containing space 331, a second ink inlet 332 allowing inflow of ink from the first ink outlet 316 of the preheating plate 310 to the ink-containing space 331, and one or more second outlets 333 supplying the ink from the ink-containing space 331 to the inkjet printhead chip 100. The ink-containing space 331 may be defined in a surface of the ink reservoir 330 opposite to the preheater 320, and may have a rectangular shape with a predetermined depth. The ink reservoir 330 may be in contact with a surface of the preheater 320, to be heated thereby, such that the ink in the ink-containing space 331 can be heated.

Figure 5A:
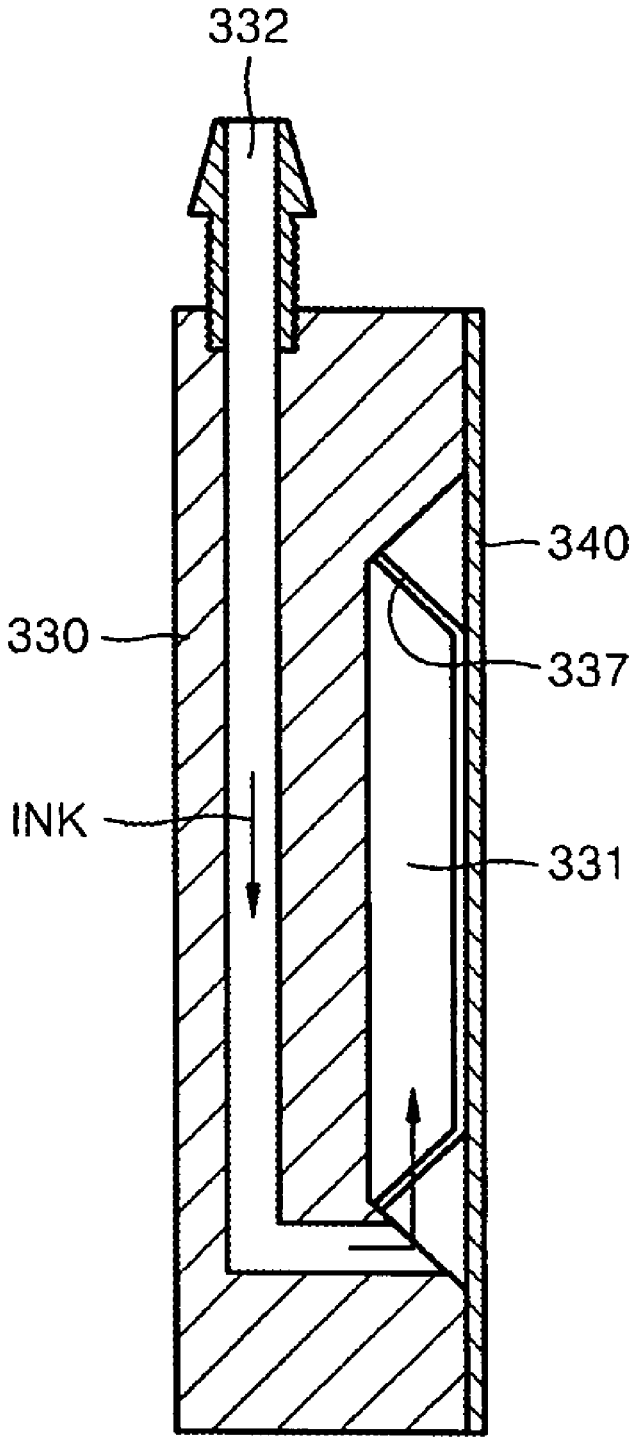
FIG. 5A illustrates a vertical sectional view taken along line A-A' of FIG. 4.

The second ink inlet 332 of the ink reservoir 330 may be connected with the first ink outlet 316 of the preheating plate 310 via, e.g., a connecting tube 350. Thus, ink discharged through the first ink outlet 316 may be directed to the second ink inlet 332 via the connecting tube 350. As illustrated in FIGS. 4 and 5A, the second ink inlet 332 may be coupled to a channel that conducts ink from the top of the ink reservoir 330 to the bottom of the ink-containing space 331, such that ink is fed into the bottom of the ink-containing space 331. That is, ink may flow into the bottom of the ink-containing space 331. Thus, bubbles or foreign substances contained in the ink may float toward a top surface of the ink in the ink containing space 331.

Figure 5B:
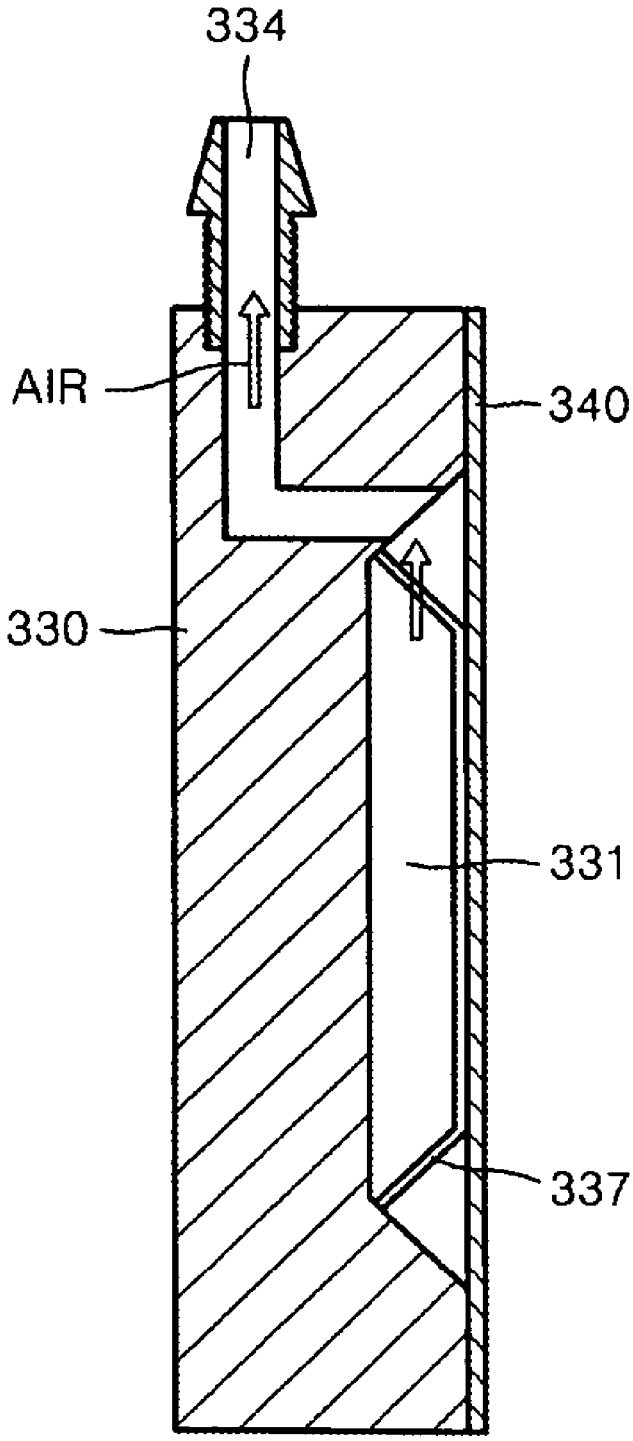
FIG. 5B illustrates a vertical sectional view taken along line B-B' of FIG. 4.

The ink reservoir 330 may include an air vent 334 that communicates with the ink-containing space 331. The air vent 334 may allow any air that separates from the ink and collects in the upper portion of the ink-containing space 331 to be discharged to the outside. The air vent 334, as shown in FIGS. 4 and 5B, may be formed from the top of the ink containing space 331 to an outer top surface of the ink reservoir 330.

Figure 5C:
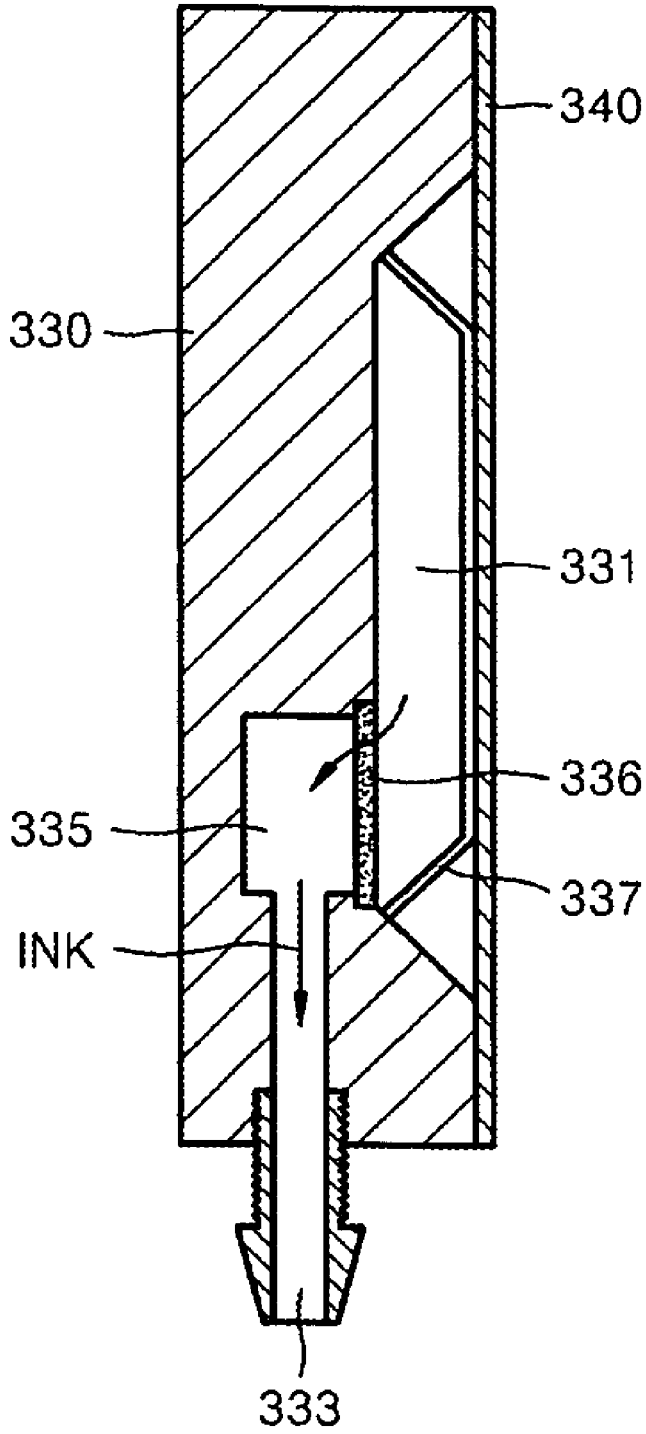
FIG. 5C illustrates a vertical sectional view taken along line C-C' of FIG. 4.

The second ink outlets 333 of the ink reservoir 330 may be connected via ink supply tubes 250 to ink supply holes 202 (described below) of the frame 200. Ink discharged through the second ink outlets 333 may be supplied to the inkjet printhead chip 100 via the ink supply tubes 250 and the ink supply holes 202 of the frame 200. Referring to FIGS. 4 and 5C, the second ink outlets 333 may be formed from the bottom of the ink-containing space 331 through the bottom of the ink reservoir 330, and may be formed at both sides of the bottom of the ink-containing space 331.

Filters 336 may be provided in the ink containing space 331 adjacent to the second ink outlets 333 to isolate any foreign substances from the ink. In detail, as illustrated in FIG. 5C, concave recesses 335 may be formed in a surface of the ink containing space 331, and the filters 336 may be installed to span the concave recesses 335. The second ink outlets 333 may communicate with the concave recesses 335. Stainless steel mesh that does not react with the ink may be used for the filters 336, although the present invention is not limited to filters of this type, and various other types of filters may be used.

According to the present invention, ink in the ink-containing space 331 may flow into the concave recesses 335 through the filters 336, such that foreign substances may be removed from the ink by the filters 336. Then, the ink may be supplied to the inkjet printhead chip 100 from the concave recesses 335 by way of the second ink outlets 333.

Referring again to FIG. 5C, the pressure adjusting film 340 may be attached to a surface of the ink reservoir 330 to cover the ink-containing space 331. The pressure adjusting film 340 may be flexible and may have a thickness of, e.g., roughly 100 μm or less. Like the ink reservoir 330, the pressure adjusting film 340 may be formed of, e.g., a plastic such as PP, PE, PTFE, etc. In this case, the pressure adjusting film 340 may be attached to the ink reservoir 330 by applying heat and pressure (hot melt adhesion) to increase adhesion strength and durability.

The shape of the pressure adjusting film 340 may vary in response to the pressure of the ink-containing space 331, such that the pressure of the ink-containing space 331 may be kept constant. That is, if the pressure of the ink containing space 331 decreases, the pressure adjusting film 340 may bend toward the ink-containing space 331 to increase the pressure of the ink-containing space 331, and if the pressure of the ink-containing space 331 increases, the pressure adjusting film 340 may bend outward from the ink-containing space 331 to decrease the pressure thereof. By this bending motion of the pressure adjusting film 340, ink may be supplied to the inkjet printhead chip 100 at a relatively constant pressure, thereby enabling stable ink-ejecting performance.

If the pressure of the ink containing space 331 increases too much, e.g., to a level higher than atmospheric pressure, the ink contained in the ink containing space 331 may run out through nozzles 106 of the inkjet printhead chip 100. To avoid this, a spring 337 may be installed in the ink containing space 331 to help maintain the pressure of the ink containing space 331 at a pressure below a predetermined pressure, e.g., below atmospheric pressure. The spring 337 can have various shapes suitable for the shape of the ink containing space 331, and is not limited to the shape illustrated in FIG. 4.

Figure 6:
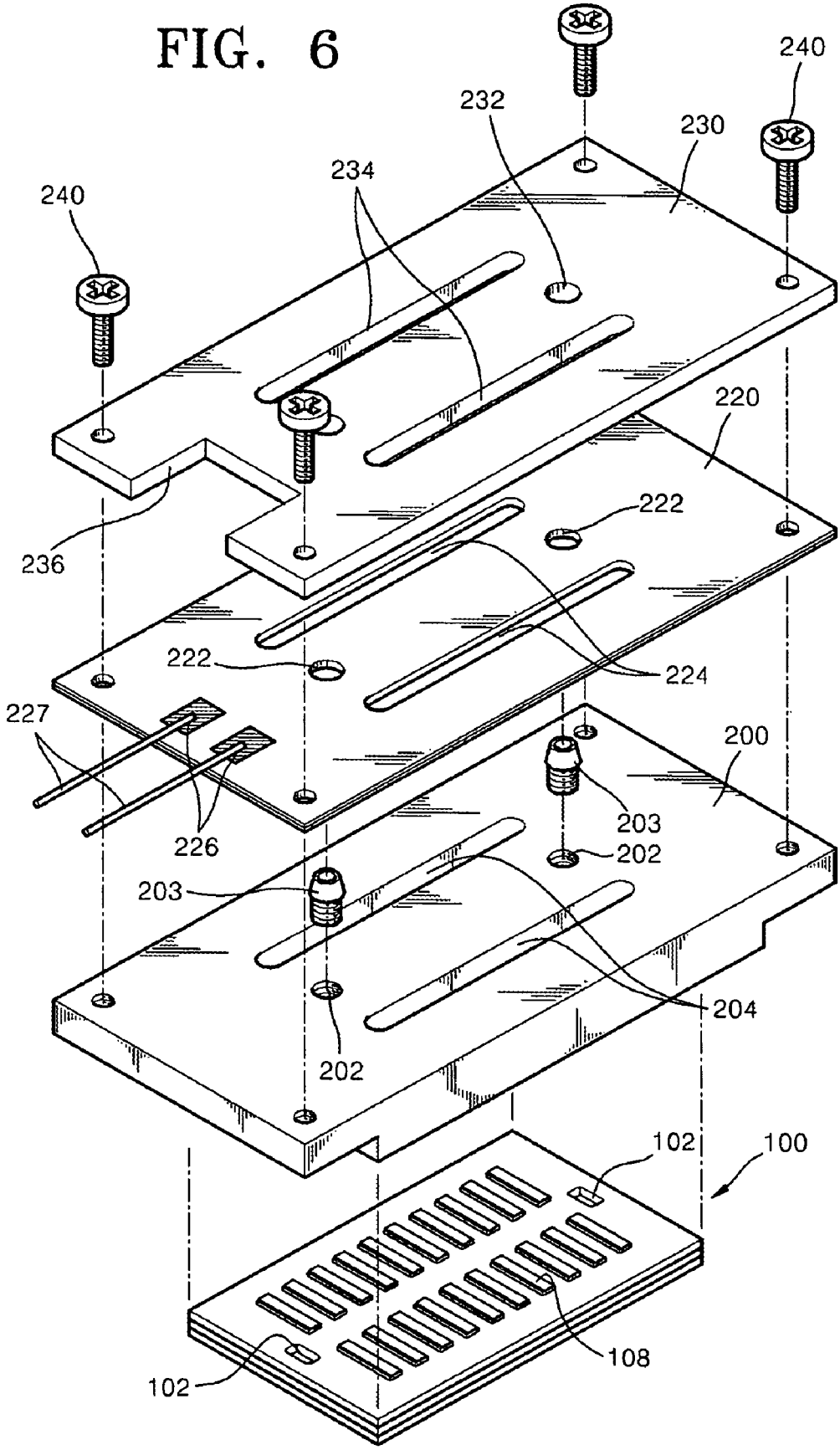
FIG. 6 illustrates an exploded perspective view of a frame and an inkjet printhead chip depicted in FIG. 1.
Figure 7:
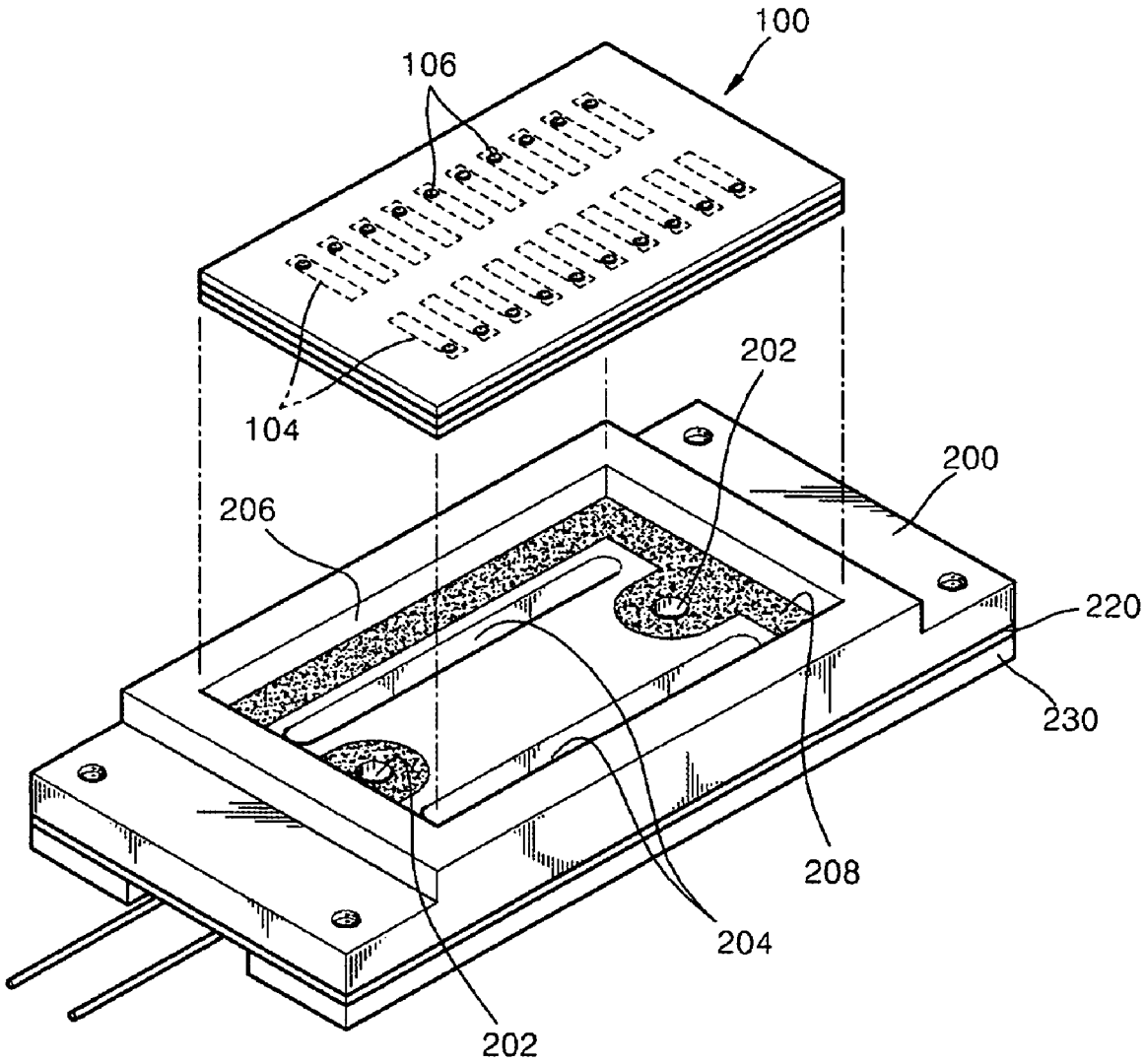
FIG. 7 illustrates a bottom perspective view of a frame and an inkjet printhead chip depicted in FIG. 1.

FIGS. 6 and 7 illustrate, respectively, an exploded perspective view and a bottom perspective view of a frame and an inkjet printhead chip depicted in FIG. 1. Referring to FIGS. 1, 6, and 7, the frame 200 may include ink supply holes 202 passing therethrough in a vertical direction. The ink supply holes 202 may correspond to ink inflow holes 102 of the inkjet printhead chip 100, to allow ink to flow into a plurality of ink chambers 104 defined in the inkjet printhead chip 100. Two ink supply holes 102 are illustrated in FIG. 6, although one ink supply hole, or more than two, may also be used. The ink supply holes 202 may be connected to the second ink outlets 333 of the ink reservoir 330. As described above, the ink supply holes 202 and the second ink outlets 333 may be connected via the ink supply tubes 250. Nipples 203 may be installed into the ink supply holes 202 for connecting the ink supply tubes 250 with the ink supply holes 202.

The frame 200 may include two slots 204, which may extend in a length direction of the frame 200 and pass through the frame 200 in a vertical direction. A flexible printed circuit (FPC, not shown) may be connected to the printhead chip 100 through the slots 204 to supply driving voltage to the printhead chip 100. Of course, the present invention is not limited to the illustrated embodiment, and other arrangements may also be used. For example, instead of the two slots 204, an opening may be defined through the frame 200 in a vertical direction, the two slots 204 may be defined through both side surfaces of the frame 200, etc.

The inkjet printhead chip 100 may receive ink through the ink supply holes 202 and eject the received ink through the plurality of nozzles 106. For this, the inkjet printhead chip 100 may include the ink inflow holes 102 in a top surface, and the ink inflow holes 102 may communicate with the ink supply holes 202 defined in the frame 200. The inkjet printhead chip 100 may further include the plurality of ink chambers 104 containing the ink supplied through the ink inflow holes 102, and the plurality of nozzles 106 on a bottom surface. The plurality of nozzles 106 may correspond to the plurality of chambers 106, respectively. The inkjet printhead chip 100 may further include actuators 108 on a top surface. The actuators 108 may provide driving forces for ejecting the ink, contained in the ink chambers 104, through the nozzles 106. Of course, the present invention is not limited to the illustrated arrangement, which is merely exemplary, and the inkjet printhead chip 100 may have other structures besides the above-described structure.

The inkjet printhead chip 100 may be mounted to a bottom of the frame 200. A mounting groove 206 may be defined in the bottom of the frame 200 to receive the inkjet printhead chip 100. The depth of the mounting groove 206 may be substantially the same as the thickness of the inkjet printhead chip 100. An adhesive 208 may be disposed along the bottom of the mounting groove 206 around the ink supply holes 202, and along edges of the bottom, to firmly attach and seal the inkjet printhead chip 100 to the frame 200. Various adhesives having high adhering and sealing properties, such as room temperature vulcanizing (RTV) silicone resin, epoxy resin, etc., may be used for the adhesive 208.

An auxiliary heater 220 may be installed on a top of the frame 200 to heat ink contained in the inkjet printhead chip 100. The auxiliary heater 220 may have the same structure as the preheater 320 shown in FIG. 3. The auxiliary heater 220 may be flat and may be installed on the top of the frame 200 in parallel with the inkjet printhead chip 100. The auxiliary heater 200 may have slots 224 defined therein at positions corresponding to the slots 204 of the frame 200. The slots 224 of the auxiliary heater 220 have the same shapes as the slots 204 of the frame 200. The auxiliary heater 220 may further include nipple insertion holes 222 to receive the nipples 203 installed in the ink supply holes 202 of the frame 200. Contact pads 226 may be attached to one side of a top surface of the auxiliary heater 220, and power supply lines 227 may be connected to the contact pads 226 to supply power to the auxiliary heater 220. By providing the auxiliary heater 220 in this manner, ink contained in the printhead chip 100 may be uniformly heated. Further, the auxiliary heater 220 may reduce the load on the preheater 320, and thus it may be possible to more precisely control the temperature of the ink.

A heater cover 230 may be installed to cover a top of the auxiliary heater 220. The heater cover 230 may include slots 234 and nipple insertion holes 232 corresponding to the slots 224 and the nipple insertion holes 222 of the auxiliary heater 220. The heater cover 230 may further include an opening 236 to expose the contact pads 226 of the auxiliary heater 220. The heater cover 230 may be securely fixed to the frame 200 using screws 240, and, therefore, the auxiliary heater 220, interposed between the heater cover 230 and the frame 200, may be pressed against the frame 200. Thus, heat may be effectively conducted to the frame 200 from the auxiliary heater 220.

Figure 8:
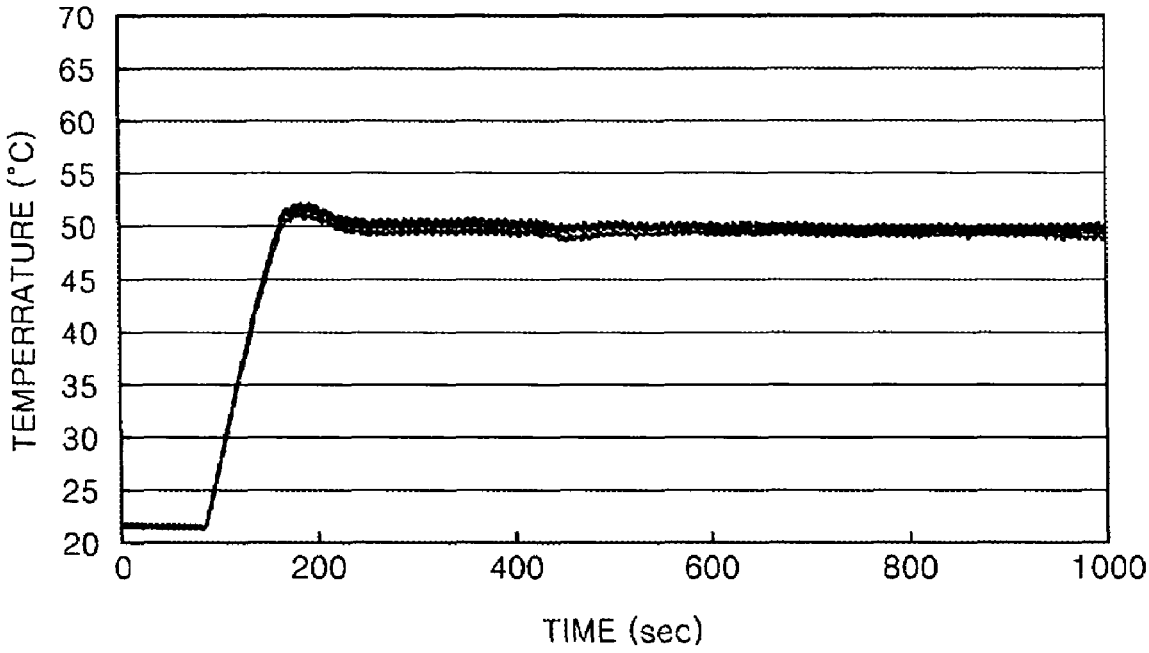
FIG. 8 illustrates a graph of temperature versus time for ink ejected from an inkjet printhead chip of an inkjet printhead assembly according to the present invention.

FIG. 8 illustrates a graph of temperature versus time for ink ejected from an inkjet printhead chip of an inkjet printhead assembly according to the present invention. In particular, the temperature of ink ejected from ten nozzles was measured. The temperature of the ink was set at 50° C., the driving frequency was set at 20 kHz and the ink flow rate was set at 4 cc/min. As illustrated in FIG. 8, the ink may reach the set temperature of 50° C. in a short time and remain there. In addition, it is evident that the temperatures of the ink ejected from each of the nozzles were very uniform.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An inkjet printhead assembly, comprising:

an inkjet printhead chip having an ink inflow hole, a frame having an ink supply hole, and an ink supply apparatus having a preheater and an ink supply outlet, wherein:

the frame is disposed between the inkjet printhead chip and the ink supply apparatus, the inkjet printhead chip is attached to the frame, the ink supply hole is disposed between the ink supply outlet and the ink inflow hole, so as to channel ink between the ink supply apparatus and the inkjet printhead chip, and the ink supply apparatus further includes a preheating plate, an ink reservoir and a pressure adjusting film.

2. The inkjet printhead assembly as claimed in claim 1, wherein the inkjet printhead chip comprises:

a plurality of ink chambers communicating with the ink inflow hole;

a plurality of actuators corresponding to the plurality of ink chambers; and a plurality of nozzles corresponding to the plurality of ink chambers.

3. The inkjet printhead assembly as claimed in claim 1, further comprising a heater disposed on a surface of the frame opposite the inkjet printhead chip.

4. The inkjet printhead assembly as claimed in claim 3, further comprising a heater cover disposed on the heater and pressing the heater against the frame.

5. The inkjet printhead assembly as claimed in claim 1, wherein the frame includes a mounting groove in a bottom surface thereof, and the inkjet printhead chip is disposed in the mounting groove.

6. The inkjet printhead assembly as claimed in claim 1, wherein:

the preheating plate includes an ink path having a first ink inlet and a first ink outlet, the ink reservoir includes an ink-containing space and a second ink inlet communicating with the first ink outlet, the pressure adjusting film is attached to the ink reservoir and covers the ink-containing space, and the preheater is disposed between, and is in thermal contact with, the preheating plate and the ink reservoir.

7. The inkjet printhead assembly as claimed in claim 1, wherein the ink reservoir includes a spring and a pressure adjusting film that are configured to maintain an ink pressure below a predetermined pressure.

8. An ink supply apparatus for an inkjet printhead chip, comprising:

a preheating plate including an ink path having a first ink inlet and a first ink outlet;

an ink reservoir including an ink-containing space, a second ink inlet communicating with the first ink outlet, and a second ink outlet communicating with the inkjet printhead chip;

a pressure adjusting film attached to the ink reservoir and covering the ink-containing space; and a preheater disposed between, and in thermal contact with, the preheating plate and the ink reservoir.

9. The ink supply apparatus as claimed in claim 8, wherein the ink path further includes:

a groove defined in a surface of the preheating plate; and a heat-exchanging tube installed in the groove, wherein the first ink inlet is one end of the heat-exchanging tube and the first ink outlet is another end of the heat-exchanging tube.

10. The ink supply apparatus as claimed in claim 8, further comprising a temperature sensor disposed on the preheating plate.

11. The ink supply apparatus as claimed in claim 8, wherein the ink reservoir and the pressure adjusting film are formed of a same material and are fused together.

12. The ink supply apparatus as claimed in claim 8, wherein the second ink inlet extends from a top outer surface of the ink reservoir to a bottom of the ink-containing space, such that ink enters the ink-containing space at the bottom.

13. The ink supply apparatus as claimed in claim 8, wherein the second ink outlet extends from a bottom of the ink-containing space to a bottom outer surface of the ink reservoir.

14. The ink supply apparatus as claimed in claim 8, further comprising an air vent in the ink reservoir, the air vent communicating with the ink-containing space.

15. The ink supply apparatus as claimed in claim 14, wherein the air vent extends from a top outer surface of the ink reservoir to a top of the ink-containing space.

16. The ink supply apparatus as claimed in claim 8, further comprising a filter disposed in the ink-containing space near the second ink outlet and configured to filter ink passing through the second ink outlet.

17. The ink supply apparatus as claimed in claim 16, wherein the ink- containing space has a concave recess in a wall thereof, the concave recess communicating with the second ink outlet, and the filter spans the concave recess.

18. The ink supply apparatus as claimed in claim 8, wherein a spring is installed in the ink-containing space, and the spring and the pressure adjusting film are configured to maintain an ink pressure below a predetermined pressure.

19. The ink supply apparatus as claimed in claim 8, wherein the preheater includes:

two insulating plates arranged in parallel with each other;

a heating coil disposed between the two insulating plates; and a power supply line connected to the heating coil.

* * * * *